US011486618B2

(12) United States Patent
Schaefer et al.

(10) Patent No.: US 11,486,618 B2
(45) Date of Patent: Nov. 1, 2022

(54) INTEGRATED CONNECTOR FOR MULTI-STAGE COMPRESSOR

(71) Applicant: Danfoss A/S, Nordborg (DK)

(72) Inventors: Arnold Martin Schaefer, Wellington, FL (US); Jin Yan, Tallahassee, FL (US); Alonso Misael Perez, Fort Lauderdale, FL (US)

(73) Assignee: Danfoss A/S

( * ) Notice: Subject to any disclaimer, the term of this patent is extended or adjusted under 35 U.S.C. 154(b) by 483 days.

(21) Appl. No.: 16/599,982

(22) Filed: Oct. 11, 2019

(65) Prior Publication Data

US 2021/0108838 A1 Apr. 15, 2021

(51) Int. Cl.

| | |
|---|---|
| ***F25B 1/10*** | (2006.01) |
| ***F04D 29/42*** | (2006.01) |
| ***F25B 41/40*** | (2021.01) |
| ***F04D 1/02*** | (2006.01) |
| ***F04D 17/12*** | (2006.01) |
| ***F04D 23/00*** | (2006.01) |
| ***F04D 29/28*** | (2006.01) |

(52) U.S. Cl.

CPC ..... *F25B 41/40* (2021.01); *F04D 1/02* (2013.01); *F04D 17/122* (2013.01); *F04D 23/003* (2013.01); *F04D 29/28* (2013.01); *F04D 29/4206* (2013.01); *F25B 1/10* (2013.01)

(58) Field of Classification Search

CPC . F04D 1/02; F04D 1/06; F04D 17/122; F04D 23/003; F04D 29/28; F04D 29/403; F04D 29/4206; F25B 1/10; F25B 41/40

See application file for complete search history.

(56) References Cited

U.S. PATENT DOCUMENTS

| | | | | |
|---|---|---|---|---|
| 3,741,676 | A * | 6/1973 | Silvern | F04D 27/0215 415/58.4 |
| 5,857,348 | A * | 1/1999 | Conry | F04D 29/058 417/423.12 |
| 6,471,493 | B2 * | 10/2002 | Choi | F04D 25/16 417/357 |
| 6,997,686 | B2 * | 2/2006 | Agrawal | F04D 25/0606 417/370 |
| 8,061,151 | B2 * | 11/2011 | Telakowski | F04D 25/06 62/115 |
| 9,671,139 | B2 * | 6/2017 | Creamer | G05B 13/024 |
| 9,863,272 | B2 * | 1/2018 | Shoyama | F01D 5/12 |

(Continued)

OTHER PUBLICATIONS

International Search Report and Written Opinion for International Application No. PCT/US2020/054369 dated Jan. 5, 2021.

*Primary Examiner* — Brian P Wolcott

(74) *Attorney, Agent, or Firm* — Carlson, Gaskey & Olds, P.C.

(57) ABSTRACT

This disclosure relates to a compressor having at least two compression stages. In particular, an exemplary compressor includes a first radial compression stage arranged along an axis, a second radial compression stage arranged along the axis, and a connector fluidly connecting an outlet of the first radial compression stage to an inlet of the second radial compression stage. The connector has a plurality of sections arranged about the axis. The compressor may be a refrigerant compressor used in a heating, ventilation, and air conditioning (HVAC) chiller system.

21 Claims, 4 Drawing Sheets

(56) References Cited

U.S. PATENT DOCUMENTS

| | | | | |
|---|---|---|---|---|
| 2010/0287958 | A1 | 11/2010 | Telakowski et al. | |
| 2015/0316064 | A1 | 11/2015 | Kosamana et al. | |
| 2015/0362233 | A1* | 12/2015 | Jandal | F25B 45/00 62/468 |
| 2018/0038380 | A1 | 2/2018 | Morgan et al. | |
| 2018/0224168 | A1 | 8/2018 | Verma et al. | |
| 2019/0323746 | A1* | 10/2019 | Gashi | F04D 29/056 |
| 2021/0348615 | A1* | 11/2021 | Kim | F25B 31/026 |

* cited by examiner

INTEGRATED CONNECTOR FOR MULTI-STAGE COMPRESSOR

TECHNICAL FIELD

This disclosure relates to an inter-stage connector for a compressor having at least two stages. The compressor may a refrigerant compressor, which may be used in a heating, ventilation, and air conditioning (HVAC) chiller system, for example.

BACKGROUND

Refrigerant compressors are used to circulate refrigerant in a chiller via a refrigerant loop. Refrigerant loops are known to include a condenser, an expansion device, and an evaporator. The compressor compresses the fluid, which then travels to a condenser, which in turn cools and condenses the fluid. The refrigerant then goes to an expansion device, which decreases the pressure of the fluid, and to the evaporator, where the fluid is vaporized, completing a refrigeration cycle.

Many refrigerant compressors are centrifugal compressors and have an electric motor that drives at least one impeller to pressurize refrigerant. The at least one impeller is mounted to a rotatable shaft.

SUMMARY

A refrigerant compressor according to an exemplary aspect of the present disclosure includes, among other things, a first radial compression stage arranged along an axis, a second radial compression stage arranged along the axis, and a connector fluidly connecting an outlet of the first radial compression stage to an inlet of the second radial compression stage, the connector having a plurality of sections arranged about the axis.

In a further non-limiting embodiment of the foregoing refrigerant compressor, the first and second radial compression stages are arranged within a housing, and the plurality of sections extend outside the housing.

In a further non-limiting embodiment of the foregoing refrigerant compressor, the connector is integrated with an exterior of the housing.

In a further non-limiting embodiment of the foregoing refrigerant compressor, the plurality of sections comprises three sections spaced 120° apart from one another about the axis.

In a further non-limiting embodiment of the foregoing refrigerant compressor, each of the plurality of sections comprises a channel that communicates fluid from the outlet to the inlet.

In a further non-limiting embodiment of the foregoing refrigerant compressor, each channel includes a first radial portion near the outlet, a second radial portion near the inlet, and an axial portion extending between the first and second radial portions.

In a further non-limiting embodiment of the foregoing refrigerant compressor, a pocket is formed in each channel between the outlet and the inlet.

In a further non-limiting embodiment of the foregoing refrigerant compressor, the pressure pocket is arranged between the first radial portion and the axial portion.

In a further non-limiting embodiment of the foregoing refrigerant compressor, the first and second compression stages are configured to compress a fluid, wherein the fluid is a refrigerant.

In a further non-limiting embodiment of the foregoing refrigerant compressor, the first radial compression stage includes a first impeller arranged on a shaft and the second radial compression stage includes a second impeller arranged on the shaft.

In a further non-limiting embodiment of the foregoing refrigerant compressor, fluid is configured to flow into the first radial compression stage in a first direction and the fluid is configured to flow into the inlet of the second radial compression stage in a second direction that is opposite the first direction.

In a further non-limiting embodiment of the foregoing refrigerant compressor, the refrigerant compressor is used in a heating, ventilation, and air conditioning (HVAC) chiller system.

A refrigerant system according to an exemplary aspect of the present disclosure includes, among other things, a main refrigerant loop including a compressor, a condenser, an evaporator, and an expansion device. The compressor includes a first radial compression stage arranged along an axis, a second radial compression stage arranged along the axis, and a connector fluidly connecting an outlet of the first radial compression stage to an inlet of the second radial compression stage, the connector having a plurality of sections arranged about the axis.

In a further non-limiting embodiment of the foregoing refrigerant system, fluid is configured to flow into the first radial compression stage in a first direction and the fluid is configured to flow into the inlet of the second radial compression stage in a second direction that is opposite the first direction.

In a further non-limiting embodiment of the foregoing refrigerant system, the first radial compression stage includes a first impeller arranged on a shaft and the second radial compression stage includes a second impeller arranged on the shaft.

In a further non-limiting embodiment of the foregoing refrigerant system, each of the plurality of sections comprises a channel that communicates fluid from the outlet to the inlet.

In a further non-limiting embodiment of the foregoing refrigerant system, each channel includes a first radial portion near the outlet, a second radial portion near the inlet, and an axial portion extending between the first and second radial portions.

In a further non-limiting embodiment of the foregoing refrigerant system, a pocket is formed in each channel between the outlet and the inlet.

In a further non-limiting embodiment of the foregoing refrigerant system, the pocket is arranged between the first radial portion and the axial portion.

In a further non-limiting embodiment of the foregoing refrigerant system, the first and second radial compression stages are arranged within a housing, and the plurality of sections extend outside the housing.

DETAILED DESCRIPTION

Figure 1:
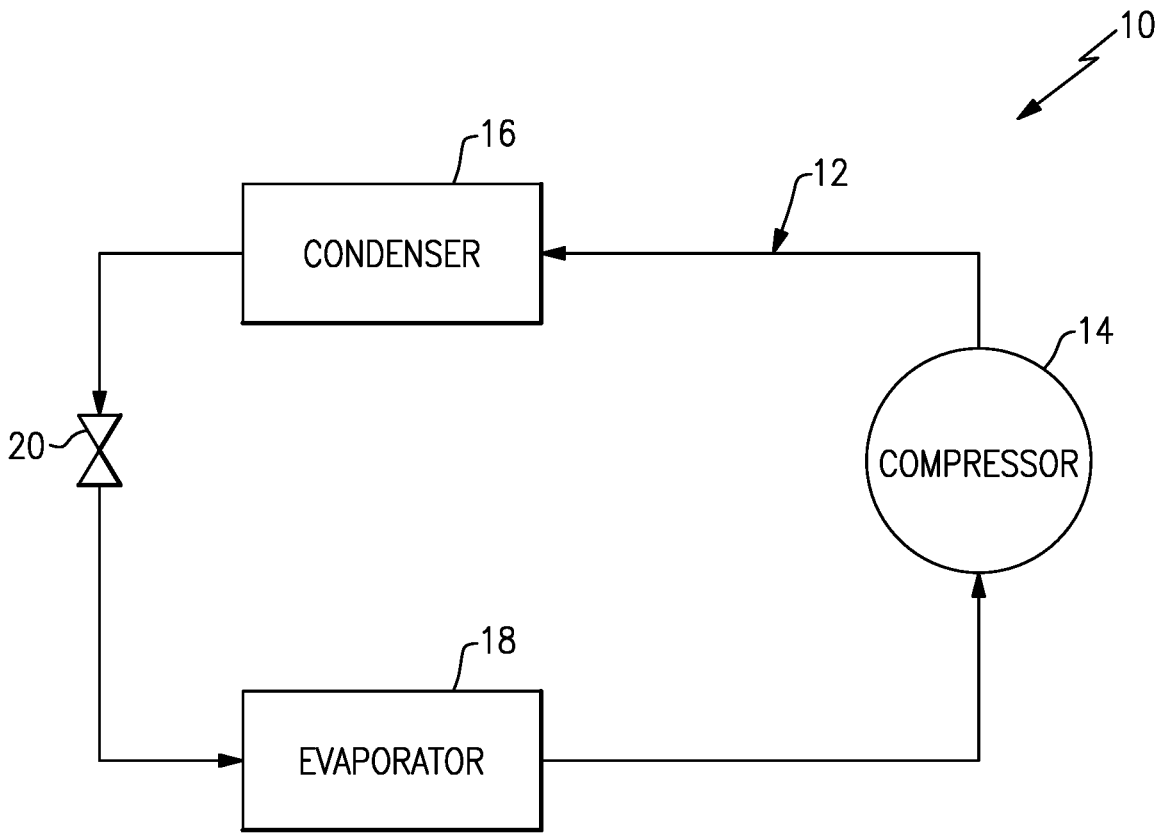
FIG. 1 schematically illustrates an example refrigerant system.

FIG. 1 illustrates a refrigerant system 10. The refrigerant system 10 includes a main refrigerant loop, or circuit, 12 in communication with a compressor 14, a condenser 16, an evaporator 18, and an expansion device 20. This refrigerant system 10 may be used in a chiller, for example. In that example, a cooling tower may be in fluid communication with the condenser 16. While a particular example of the refrigerant system 10 is shown, this application extends to other refrigerant system configurations, including configurations that do not include a chiller. For instance, the main refrigerant loop 12 can include an economizer downstream of the condenser 16 and upstream of the expansion device 20.

Figure 2:
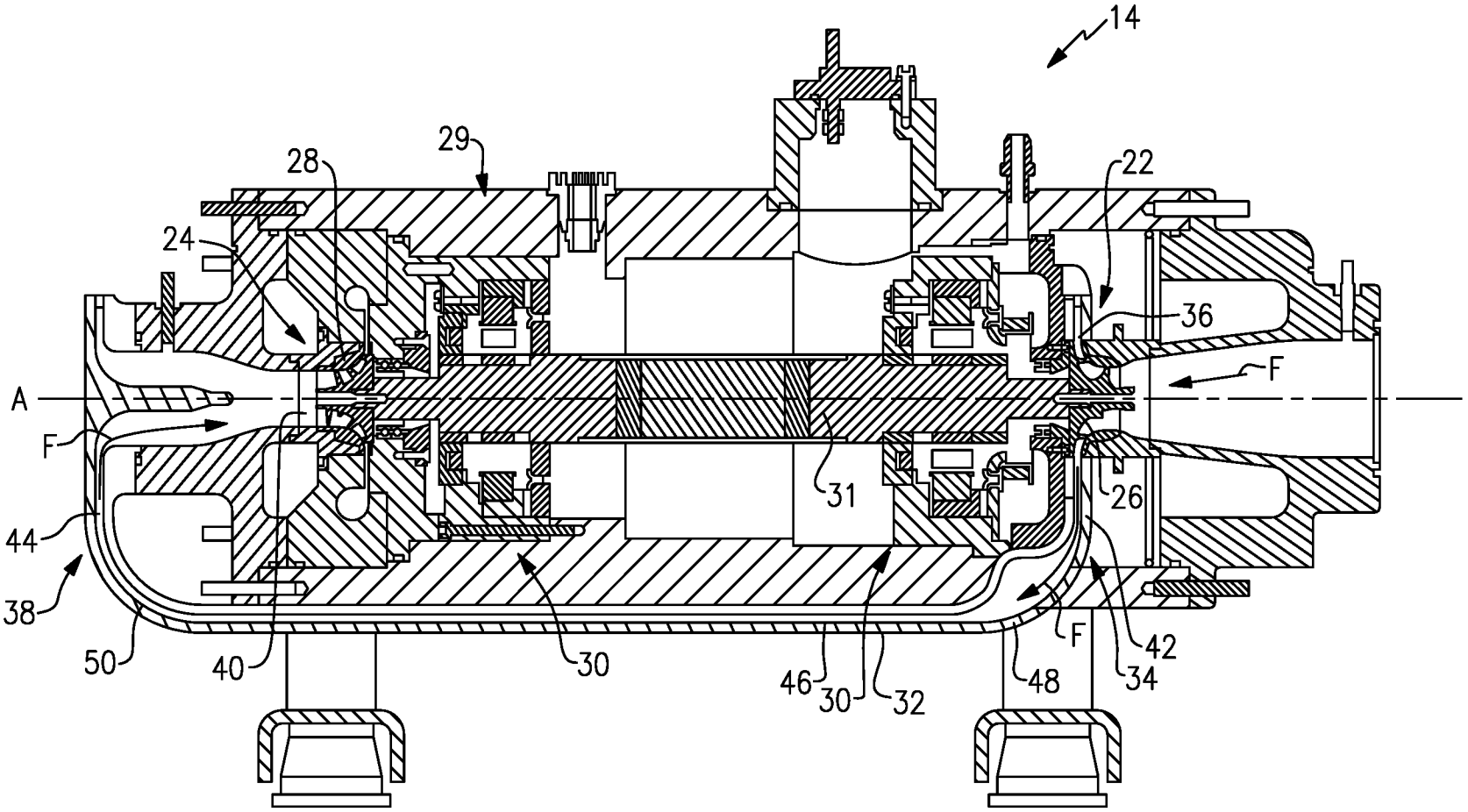
FIG. 2 illustrates an example compressor having two compression stages and an exemplary inter-stage connector.

FIG. 2 illustrates an example refrigerant compressor 14 according to this disclosure. In this example, the compressor 14 has two compression stages 22, 24 arranged in series and spaced-apart from one another along a central longitudinal axis A of the compressor 14.

In this example, the compression stages 22, 24 each include an impeller 26, 28, respectively, rotatable about the axis A via a motor 30. In this example, the motor 30 is an electric motor arranged about the axis A, and the impellers 26, 28 are rotatably coupled and directly connected to a shaft 31 which is configured to be rotatably driven about the axis A by the motor 30. The impellers 26, 28 are mounted adjacent opposite ends of the shaft 31. This arrangement may be referred to as a back-to-back impeller arrangement. In a back-to-back arrangement, fluid F flows into the first compression stage 22 in a first direction and fluid F flows into the second compression stage 24 in a second direction that is opposite the first direction. The shaft 31 may be rotatably supported by magnetic bearings or by other bearings, such as gas bearings including static and dynamic gas bearings like foil bearings or rigid grooved bearings. The first and second compression stages 22, 24 are arranged within a housing 29.

With continued reference to FIG. 2, during use, fluid F, such as refrigerant, enters the compressor 14 and is pressurized by impeller 26 within the first compression stage 22. The outlet of the first compression stage 22 is fluidly coupled to the inlet of the second compression stage 24 via a connector 32. As such, the fluid F is again pressurized by the impeller 28 within the second compression stage 24. The outlet of the second compression stage 24 is fluidly coupled to the main refrigerant loop 12, and in particular the condenser 16.

The connector 32 has a first end 34 arranged at an outlet 36 of the first compression stage 22. The connector 32 has a second end 38 arranged at an inlet 40 of the second compression stage 24. The connector 32 generally includes a first radial portion 42 near the outlet 36 and a second radial portion 44 near the inlet 40. The first and second radial portions 42, 44 extend substantially perpendicular to the axis A. An axial portion 46 extends between the first and second radial portions 42, 44. The axial portion 46 extends substantially parallel to the axis A. A first curved portion 48 connects the first radial portion 42 and the axial portion 46. A second curved portion 50 connects the axial portion 46 and the second radial portion 44. This connector arrangement provides a smooth channel for fluid F to flow from the first compression stage 22 to the second compression stage 24.

Figure 3:
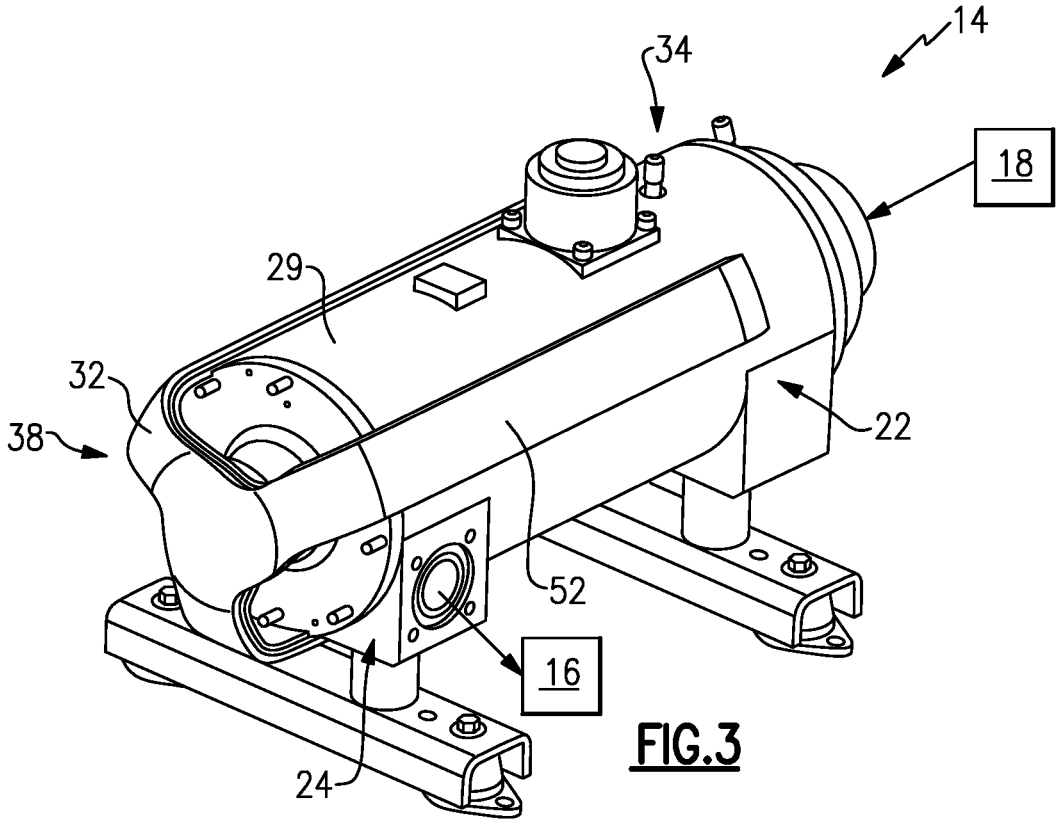
FIG. 3 illustrates a view of the example compressor and connector.

FIG. 3 illustrates another view of the compressor 14 and connector 32. Fluid enters the compressor 14 at the first compression stage 22 from the evaporator 18. Fluid F then travels from the first compression stage 22 to the second compression stage 24 via the connector 32, and exits the second compression stage 24 and flows to the condenser 16.

The connector 32 includes three channels 52 extending between the first and second compression stages 22, 24. The three channels 52 converge at the second end 38 of the connector 32, near the second compression stage 24. The connector 32 may be integrated with the housing 29, in one example. In another example, the connector 32 is attached to the housing 29, such as via bolts.

Figure 4:
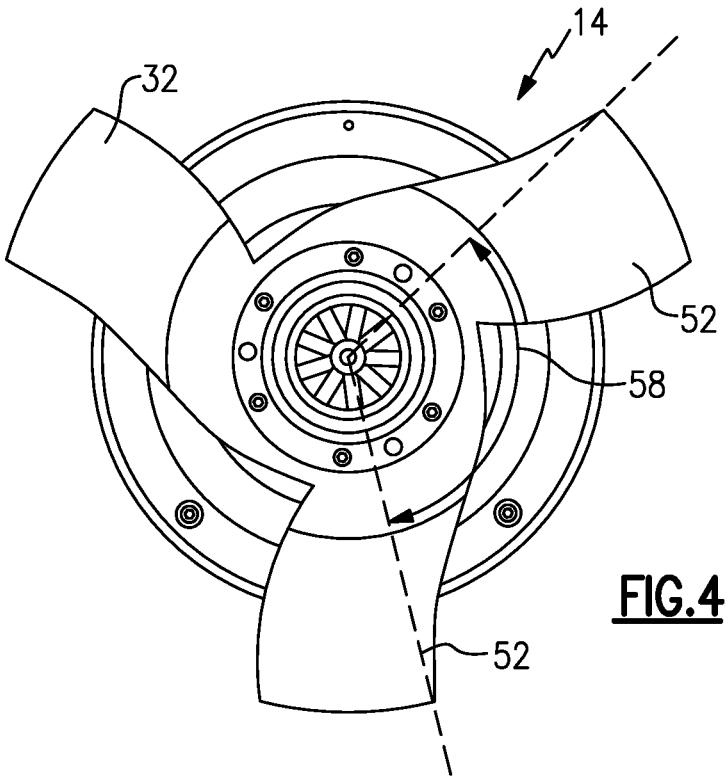
FIG. 4 illustrates a front view of the example compressor and connector.

FIG. 4 illustrates a cross-sectional view of the compressor 14 and connector 32 taken at the outlet 36 of the first compression stage 22. The three channels 52 are equally spaced about the axis A. In one example, the channels 52 are spaced apart from one another by an angle 58. In the illustrated example, the angle 58 is 120°. Although three channels are shown in the illustrated embodiment, more or fewer channels may be used within the scope of this disclosure. The channels 52 may be curved as the fluid flows radially outward to the axial portion 46. The shape of the channels 52 is designed to aerodynamically guide the flow of fluid F without creating large separations.

Figure 5:
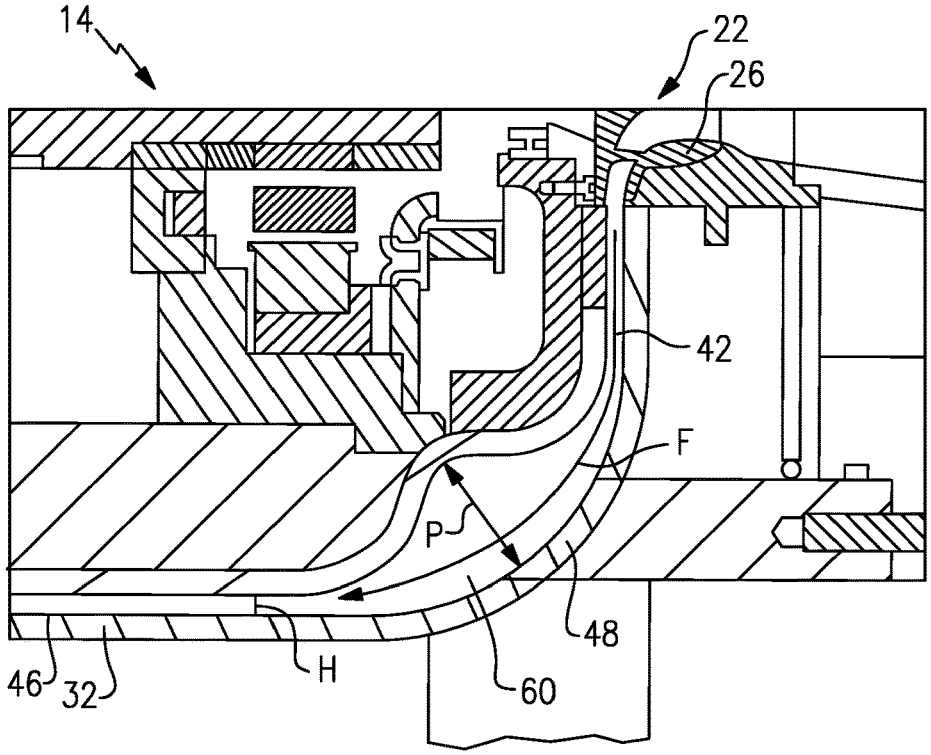
FIG. 5 illustrates a first end of the exemplary connector.

FIG. 5 illustrates the first end 34 of the connector 32. A pocket 60 is arranged at the first bend 48. The pocket 60 is between the first radial portion 42 and the axial portion 46. The pocket 60 has a larger volume than the other portions of the connector 32. In one example, the axial portion 46 has a height H that is perpendicular to the fluid flow F. The pocket 60 has a height P that is perpendicular to the fluid flow F. The height P is larger than the height H, creating a larger volume in the pocket 60. The pocket 60 provides room for the flow F to circulate around, which may create an even pressure boundary in downstream sections and stabilize the flow F.

Figure 6:
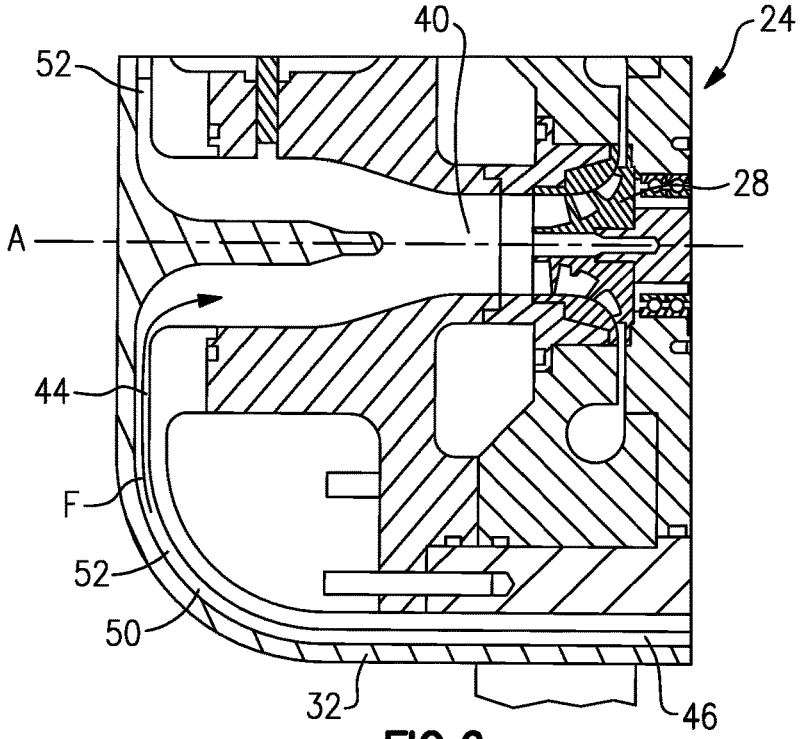
FIG. 6 illustrates a second end of the exemplary connector.

FIG. 6 illustrates the second end 38 of the connector 32. Each of the channels 52 converge at the inlet 40 of the second compression stage 24. The channels 52 converge along the axis A. Thus, the fluid flow F is parallel to the axis A as it enters the inlet 40 of the second compression stage 24.

The integrated connector 32 provides a smooth transition for fluid to flow from the outlet 36 of the first compression stage 22 to the inlet 40 of the second compression stage 24. This may improve aerodynamic performance and reduce head loss. The channels 52 are designed to aerodynamically guide the flow of fluid F without creating large separations.

It should be understood that terms such as "axial" and "radial" are used above with reference to the normal operational attitude of a compressor. Further, these terms have been used herein for purposes of explanation, and should not be considered otherwise limiting. Terms such "generally," "about," and "substantially" are not intended to be boundaryless terms, and should be interpreted consistent with the way one skilled in the art would interpret those terms.

Although the different examples have the specific components shown in the illustrations, embodiments of this disclosure are not limited to those particular combinations. It is possible to use some of the components or features from one of the examples in combination with features or components from another one of the examples.

One of ordinary skill in this art would understand that the above-described embodiments are exemplary and non-limiting. That is, modifications of this disclosure would come within the scope of the claims. Accordingly, the following claims should be studied to determine their true scope and content.

The invention claimed is:

1. A refrigerant compressor, comprising:

a first radial compression stage arranged along an axis;

a second radial compression stage arranged along the axis; and a connector fluidly connecting an outlet of the first radial compression stage to an inlet of the second radial compression stage, the connector having a plurality of channels circumferentially spaced-apart from one another about the axis and configured such that fluid flowing within each of the plurality of channels flows from the outlet to the inlet in parallel to fluid flowing within others of the plurality of channels, wherein each channel includes a first radial portion adjacent the outlet, a second radial portion adjacent the inlet, and an axial portion extending between the first and second radial portions, wherein each of the plurality of channels includes a curved portion connecting the first radial portion and the axial portion, wherein each curved portion exhibits an increased height relative to a remainder of the respective channel.

2. The refrigerant compressor as recited in claim 1, wherein the first and second radial compression stages are arranged within a housing, and the plurality of channels extend outside the housing.

3. The refrigerant compressor as recited in claim 2, wherein the connector is integrated with an exterior of the housing.

4. The refrigerant compressor as recited in claim 1, wherein the plurality of channels comprises three channels spaced 120° apart from one another about the axis.

5. The refrigerant compressor as recited in claim 1, wherein the first and second compression stages are configured to compress a fluid, wherein the fluid is a refrigerant.

6. The refrigerant compressor as recited in claim 1, wherein the first radial compression stage includes a first impeller arranged on a shaft and the second radial compression stage includes a second impeller arranged on the shaft.

7. The refrigerant compressor as recited in claim 1, wherein fluid is configured to flow into the first radial compression stage in a first direction and the fluid is configured to flow into the inlet of the second radial compression stage in a second direction that is opposite the first direction.

8. The refrigerant compressor as recited in claim 1, wherein the refrigerant compressor is used in a heating, ventilation, and air conditioning (HVAC) chiller system.

9. The refrigerant compressor as recited in claim 1, wherein each channel exhibits an increased volume within the curved portion.

10. A refrigerant system comprising:

a main refrigerant loop including a compressor, a condenser, an evaporator, and an expansion device, wherein the compressor includes:

a first radial compression stage arranged along an axis;

a second radial compression stage arranged along the axis; and a connector fluidly connecting an outlet of the first radial compression stage to an inlet of the second radial compression stage, the connector having a plurality of channels circumferentially spaced-apart from one another about the axis and configured such that fluid flowing within each of the plurality of channels flows from the outlet to the inlet in parallel to fluid flowing within others of the plurality of channels, wherein each of the plurality of channels includes a section exhibiting an increased volume relative to a remainder of the respective channel, wherein, within each section, a radially inner portion of a wall of each respective channel exhibits a concave contour when viewed from a radially outer perspective.

11. The refrigerant system of claim 10, wherein fluid is configured to flow into the first radial compression stage in a first direction and the fluid is configured to flow into the inlet of the second radial compression stage in a second direction that is opposite the first direction.

12. The refrigerant system of claim 10, wherein the first radial compression stage includes a first impeller arranged on a shaft and the second radial compression stage includes a second impeller arranged on the shaft.

13. The refrigerant system of claim 10, wherein each channel includes a first radial portion adjacent the outlet, a second radial portion adjacent the inlet, and an axial portion extending between the first and second radial portions.

14. The refrigerant system of claim 13, wherein the section provides a pocket in each channel between the outlet and the inlet.

15. The refrigerant system of claim 14, wherein the pocket is arranged between the first radial portion and the axial portion.

16. The refrigerant system of claim 10, wherein the first and second radial compression stages are arranged within a housing, and the plurality of channels extend outside the housing.

17. A refrigerant compressor, comprising:

a first radial compression stage arranged along an axis;

a second radial compression stage arranged along the axis; and a connector fluidly connecting an outlet of the first radial compression stage to an inlet of the second radial compression stage, the connector having a plurality of sections arranged about the axis, wherein each of the plurality of sections comprises a channel that communicates fluid from the outlet to the inlet, wherein each channel includes a first radial portion adjacent the outlet, a second radial portion adjacent the inlet, and an axial portion extending between the first and second radial portions, and wherein a pocket is formed in each channel between the outlet and the inlet.

18. The refrigerant compressor as recited in claim 17, wherein the first radial portion is closer to the outlet than the second radial portion, and the second radial portion is closer to the inlet than the first radial portion.

19. The refrigerant compressor as recited in claim 17, wherein each channel exhibits an increased volume within the pocket relative to areas of the channel adjacent the pocket.

20. The refrigerant compressor as recited in claim 17, wherein each channel is arranged such that the respective pocket is arranged in a curved section between the first radial portion and the axial portion.

21. The refrigerant compressor as recited in claim 20, wherein, within each curved section, a radially inner portion of a wall of each respective channel exhibits a concave contour when viewed from a radially outer perspective.

* * * * *